United States Patent [19]

Herrmann

[11] Patent Number: 4,594,800

[45] Date of Patent: Jun. 17, 1986

[54] STEAM PRESSING IRON SOLE PLATE STRUCTURE

[75] Inventor: Eggert Herrmann, Gauting, Fed. Rep. of Germany

[73] Assignee: Veit GmbH & Co., Landsberg, Fed. Rep. of Germany

[21] Appl. No.: 754,471

[22] Filed: Jul. 12, 1985

[30] Foreign Application Priority Data

Sep. 24, 1984 [DE] Fed. Rep. of Germany ..... 3435051
Jun. 12, 1985 [EP] European Pat. Off. ..... 85107274.4

[51] Int. Cl.[4] ..... D06F 75/18; D06F 75/10
[52] U.S. Cl. ..... 38/77.83; 38/77.9
[58] Field of Search ..... 38/77.9, 88, 77.7, 77.8, 38/77.82, 77.83, 93

[56] References Cited

U.S. PATENT DOCUMENTS

| | | | |
|---|---|---|---|
| 2,750,690 | 6/1956 | Gomersall | 38/77.9 |
| 2,880,531 | 4/1959 | Houck | 38/77.7 X |
| 3,103,079 | 9/1963 | Bricker et al. | |
| 3,304,636 | 2/1967 | Vieceli et al. | 38/77.9 |
| 3,335,507 | 8/1967 | Vieceli | 38/77.9 |
| 3,599,357 | 8/1971 | Gronwick | 38/77.83 X |
| 3,811,208 | 5/1974 | Vieceli et al. | |
| 3,828,452 | 8/1974 | Eaton et al. | 38/77.83 |
| 3,919,793 | 11/1975 | Toft et al. | 38/77.83 |
| 4,077,143 | 3/1978 | Walker et al. | |

FOREIGN PATENT DOCUMENTS

| | | | |
|---|---|---|---|
| 855685 | 9/1952 | Fed. Rep. of Germany | |
| 1041908 | 10/1958 | Fed. Rep. of Germany | 38/77.7 |
| 6813491 | 12/1968 | Fed. Rep. of Germany | |
| 7200080 | 12/1971 | Fed. Rep. of Germany | |
| 686569 | 1/1953 | United Kingdom | 38/77.9 |
| 1045767 | 10/1966 | United Kingdom | |
| 1587869 | 4/1981 | United Kingdom | |

*Primary Examiner*—Henry S. Jaudon
*Assistant Examiner*—Andrew M. Falik
*Attorney, Agent, or Firm*—Finnegan, Henderson, Farabow, Garrett & Dunner

[57] ABSTRACT

A steam pressing iron having a steam conduit system designed to improve the elimination of water droplets entrained by the steam. The steam conduit system includes cylindrical recesses to which the steam is supplied in a lateral tangential direction and from which the steam escapes upwards at a central region. As a result, the steam is constrained to follow a circumferentially extending vortex flow path, whereby the water droplets are flung outwards. In a preferred embodiment the wall surface of the recess is extended by a projection rising from the bottom of the recess, so that the eliminated water droplets are rapidly evaporated by contact with the heated material of the pressing iron sole.

14 Claims, 8 Drawing Figures

STEAM PRESSING IRON SOLE PLATE STRUCTURE

BACKGROUND OF THE INVENTION

The present invention relates to a steam pressing iron of the type defined in the generic clause of claim 1.

In hitherto used steam pressing irons the steam is either generated in the pressing iron itself or supplied thereto from an exterior source so as to flow along channels formed interiorly of the pressing iron body. These channels lead to outlet nozzles preferably located adjacent the tip of the pressing iron sole surface so as to direct the steam onto the fabric to be ironed. In view of the relatively low steam temperatures employed for the steam pressing process it is scarcely avoidable that the steam still contains water droplets. Particularly on steam-pressing relatively delicate fabrics, these water droplets are highly undesirable, as they may leave spots on the fabric. For this reason, various approaches have already been suggested for eliminating such water droplets from the steam as far as possible.

From DE-PS No. 55,685 there is already known a steam pressing iron having a steam conduit system including a number of recesses interconnected by channels. The recesses are of cubic configuration and disposed in a meander-type fashion one behind the other. The channels are of semicircular cross-sectional shape and open into the respective recesses at the upper side thereof facing away from the sole surface. The supply and outlet channels of each recess are coaxially aligned with one another, resulting in the respective steam flow path extending linearly over the full width of the pressing iron, reversing points being provided only adjacent the two borders of the pressing iron. Although the alternating arrangement of narrow and wider cross-sectional areas of the steam flow path results in a certain precipitation of water droplets, the drying of the steam achieved thereby cannot be satisfactory, since the known steam pressing iron requires an additional steam dryer to be provided upstream of the steam pressing iron.

Known from DE-GM No. 72 00 080 is a steam pressing iron in which a meander-type channel system for the steam is formed in the vicinity of the sole surface. Additional insert elements inserted in the channel system are intended to promote the removal of water droplets from the steam in cooperation with the meander-type steam flow path. It has been found, however, that these measures are not either sufficient for obtaining a completely dry steam.

SUMMARY OF THE INVENTION

It is therefore an object of the present invention to provide a steam pressing iron which is capable of achieving a substantially complete elimination of water droplets as required.

The construction of the steam conduit system according to the invention results in the provision of a type of steam cyclone in which the steam is constrained to flow along a helical vortex flow path, whereby the heavier water droplets are flung outwards against the wall surface by the action of centrifugal forces, while the lighter steam is able to escape at the center of the vortex.

The construction also results in an increase of the surface area of the pressing iron sole coming into contact with the steam, so that the water droplets eliminated from the steam flow may be immediately revaporized. This results in a further improvement of the drying effect of the steam conduit system according to the invention.

In one embodiment, the water droplets are extracted from the vortex flow and revaporized by the action of the heater means of the pressing iron.

The arrangement of the heater means according to the invention promotes the revaporization of the water droplets eliminated Efrom the steam flow.

The construction according to the invention results in a further improvement of the water elimination.

An embodiment according to the invention permits the degree of water elimination to be varied as required.

An embodiment according to the invention permits the steam pressing iron of the invention to be manufactured in a particularly simple and economical manner.

BRIEF DESCRIPTION OF THE DRAWINGS

Embodiments of the invention shall now be described by way of example with reference to the accompanying drawings, wherein.

DESCRIPTION OF THE PREFERRED EMBODIMENTS

Figure 1:
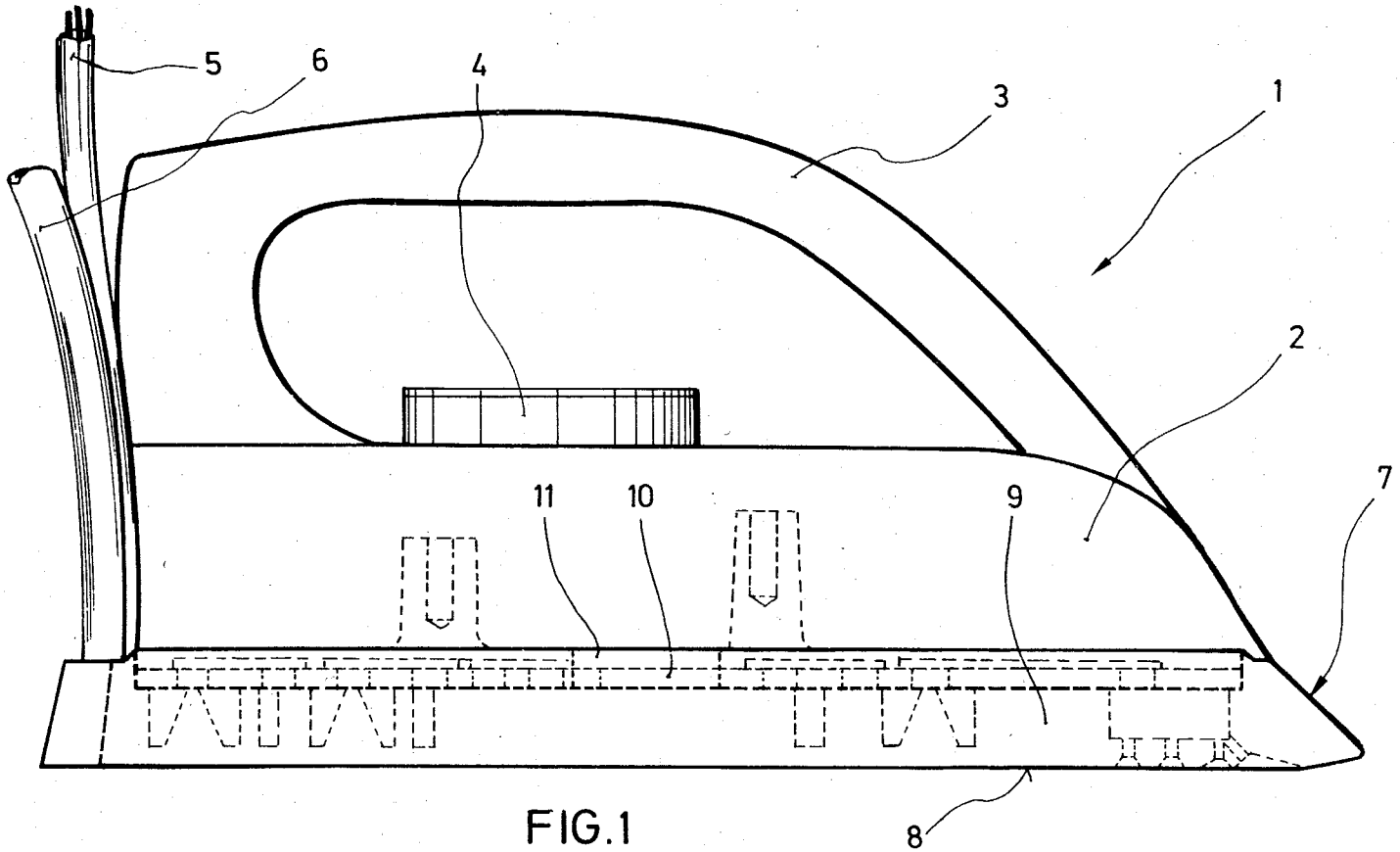
FIG. 1 shows a longitudinal sectional view of a steam pressing iron according to the invention.

FIG. 1 shows a steam pressing iron generally indicated at 1 and comprising a housing 2, a handle 3 and control and regulating means 4 e.g. for adjusting the ironing temperature. Located at the rear of steam pressing iron 1 are an electric cable 5 and a steam supply hose 6. The parts indicated above are only shown in diagrammatic form, as their particular construction is not relevant with regard to the invention.

Connected to the lower end of housing 2 is a pressing iron sole generally indicated at 7 and having a lower pressing iron sole surface 8. Pressing iron sole 7 consists of three layers 9, 10, 11, the lowermost first layer 9 being formed with sole surface 8, the third layer 11 being in contact with housing 2, and the second layer 10 being disposed between first and third layers 9 and 11, respectively.

Figure 2:
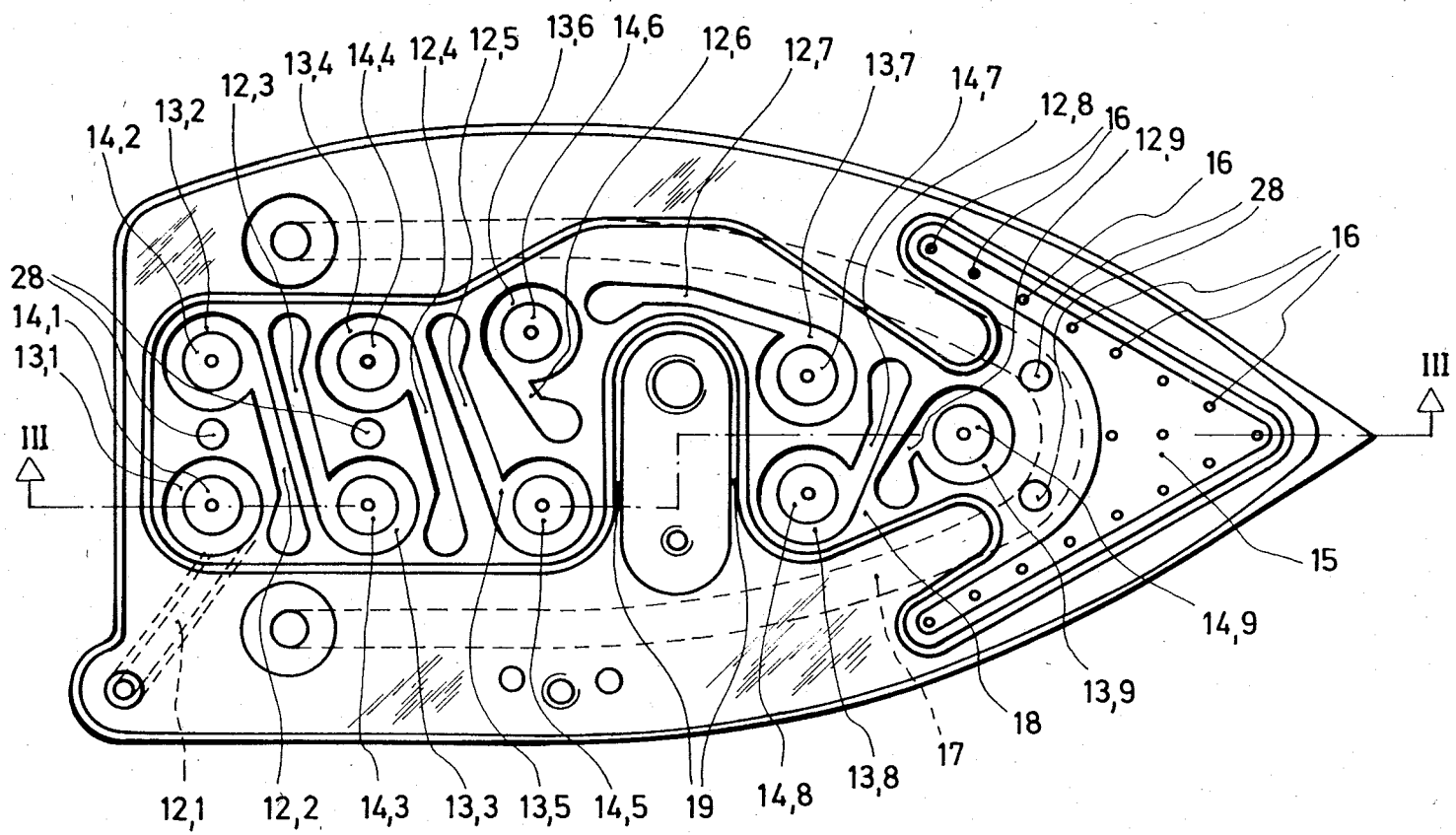
FIG. 2 shows a top plan view of the lowermost layer of a preferred embodiment of the pressing iron sole.
Figure 3:
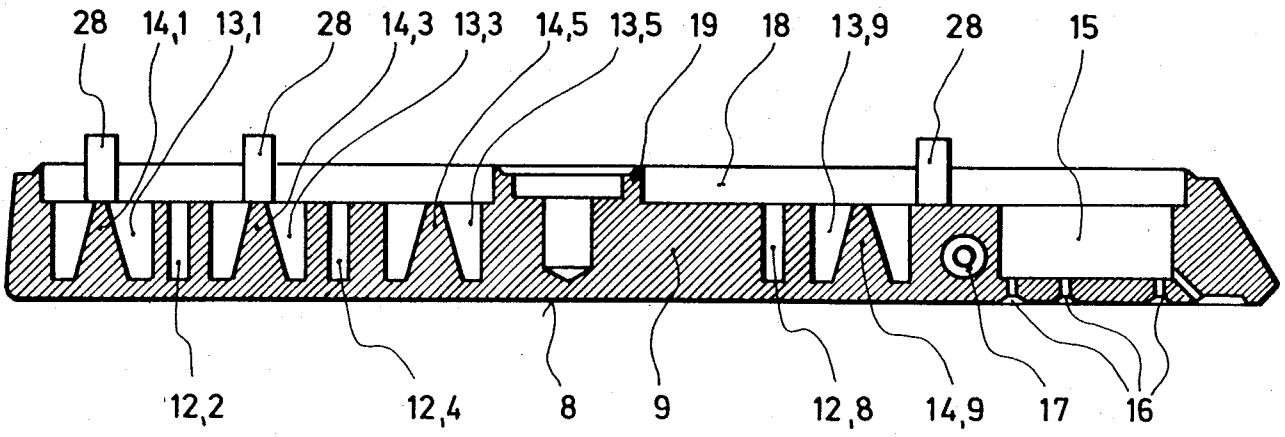
FIG. 3 shows a sectional view taken along the line III—III in FIG. 2.

An embodiment of first layer 9 is shown in detail in FIGS. 2 and 3. Steam supply hose 6 opens into a first supply channel 12,1 interiorly of first layer 9. First supply channel 12,1 opens tangentially into a first recess 13,1 having a cylindrical wall. In the immediate vicinity of first recess 13,1 there is provided a second supply channel 12,2 opening tangentially into a second recess 13,2. In the vicinity of second recess 13,2 there is a third supply channel 12,3 opening tangentially into a third recess 13,3. In this manner, and as shown in the drawing, first layer 9 is formed with a total of nine recesses 13,1 to 13,9 with associated supply channels 12,1 and 12,9. The dimensions of recesses 13 and supply channels 12 and the total number thereof may be varied as required by the available space.

Each recess 13,1 to 13,9 surrounds a projection 14.1 to 14,9, respectively. As shown in detail in FIG. 3, each projection 14 is of frustoconical shape. The base diameter of each frustoconical projection 14 is smaller than the base diameter of the respective recess 13 at the side thereof adjacent sole surface 8. The projections 14 are coaxially aligned within the respective recesses 13, their height correspinding to the depth of the recesses 13 in layer 9. From FIG. 3 it is also evident that supply channels 12 are formed as slots likewise extending over the full depth of recesses 13.

The forward portion of first layer 9 is formed with a distributor channel 15 communicating with outlet nozzles 16 opening through sole surface 8. The arrangement of recesses 13 is surrounded by a horseshoe-shaped heater element 17 which should be located as closely to the recesses 13 as possible so as to ensure optimum heating of the walls of recesses 13 and projections 14, and thus optimum vaporization of the condensate eliminated from the steam flow. Heater element 17 is connected to electric cable 5.

Supply channels 12, recesses 13 and distributor channel 15 are disposed at the bottom of a depression 18 formed in first layer 9 opposite to sole surface 8. Depression 18 is of a depth permitting layers 10 and 11 to be accommodated therein. Projecting above the bottom of depression 18 are a pedestal 19 for securing control means 4 thereto, and a number of pins 28 for centering layers 10 and 11 and for engagement with housing 2.

Figure 4:
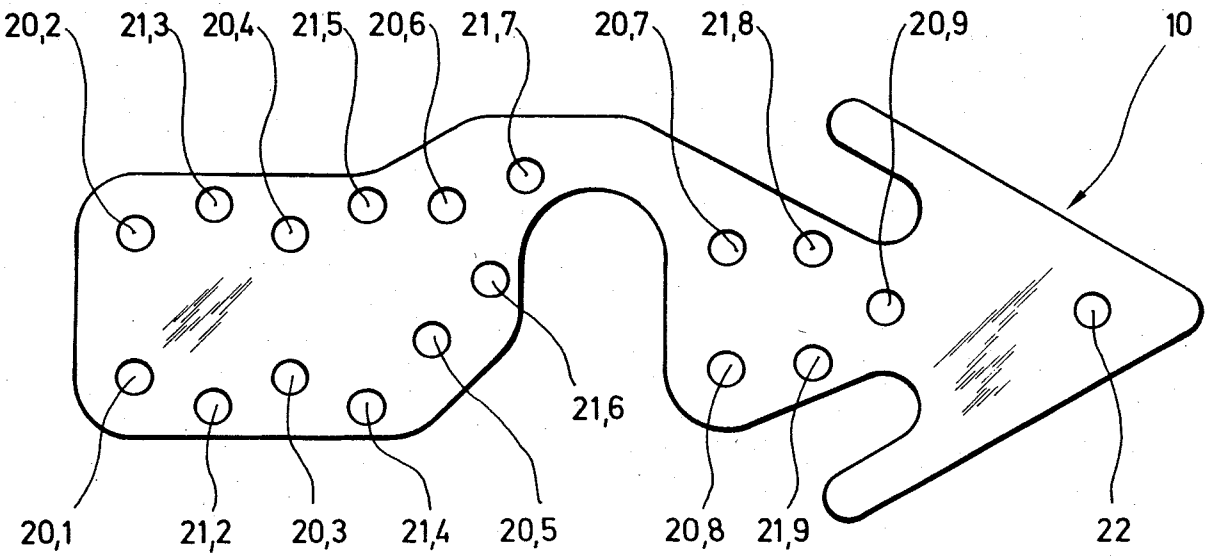
FIG. 4 shows a top plan view of an intermediate layer.

FIG. 4 shows the intermediate second layer 10 having a peripheral shape corresponding to the contours of depression 18. The centering bores for receiving pins 28 therein are not shown in the drawing for the sake of clarity. Layer 10 is formed with a plurality of through-bores, a number of which are designed as outlet channels 20, while others form portions 21 of supply channels 12.

Outlet channels 20,1 to 20,9 are so disposed that their center axes are coaxially aligned with the center axes of the respective associated recesses 13,1 to 13,9. The diameter of outlet channels 20 is greater than that of the top surface of the frustoconical projections 14, and smaller than that of recesses 13, so that second layer 10 substantially closes the upper ends of recesses 13 with the exception of an annular slot surrounding the respective projections 14.

Bores 21 are arranged so as to be located above the ends of supply channels 12 facing away form the respective recesses 13. These ends of supply channels 12 are advantageously formed with a cylindrical enlargement the diameter of which corresponds to that of the respective bore 21, the latter being substantially in coaxial alignment with the enlarged end portion on the respective supply channel. The remaining portions of supply channels 12 are covered by the surface of second layer 10. In the same manner distributor channel 15 is covered by a portion of second layer 10 formed with a passage 22.

Figure 6:
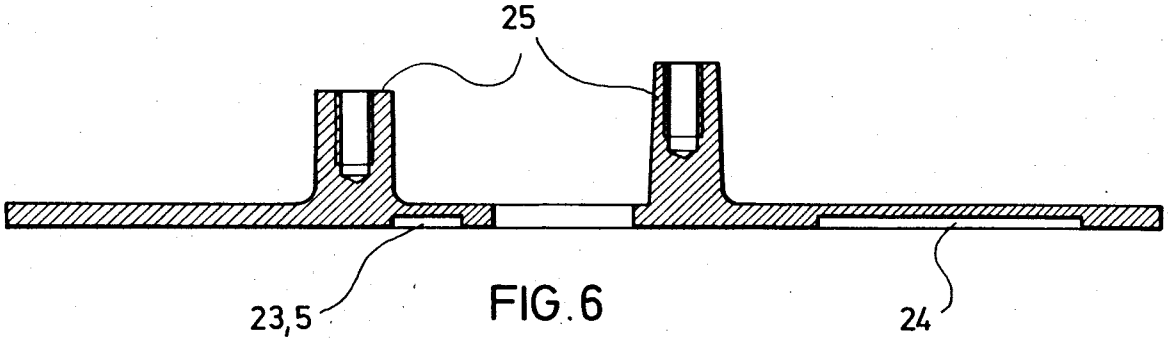
FIG. 6 shows a cross-sectional view taken along the line VI—VI in FIG. 5.
Figure 5:
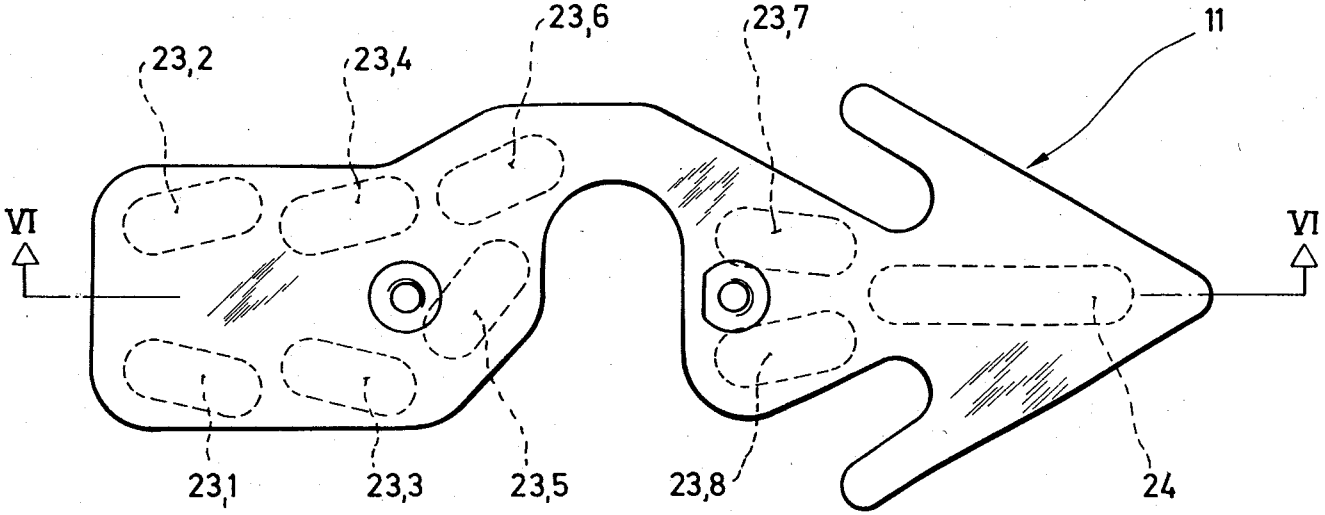
FIG. 5 shows a top plan view of an uppermost layer.

FIGS. 5 and 6 show third layer 11 to have a peripheral shape corresponding to the contours of second layer 10 and depression 18 of first layer 9. Formed in the lower surface of third layer 11 is a number of connecting channels 23,1 to 23,8. The arrangement and size of each connecting channel 23 conform to those of bores 20 and 21 of second layer 10, so that each connecting channel 23 forms a connection between the outlet channel 20 of an upstream recess 13 in the direction of steam flow and the supply channel 12 of the adjacent downstream recess 13. Connecting channel 23,1 thus establishes communication between outlet channel 20,1 of recess 13,1 and supply channel 12,2 of recess 13,2 through second layer bore 21,2. In the same manner the remaining connecting channels 23,2 to 23,8 establish communication between respective recesses 13. Located above outlet channel 20,9 in second layer 10 and thus above recess 13,9 is a further connecting channel 24, the other end of which is aligned with bore 22 so as to establish communication between downstream recess 13,9 and distributor channel 15 with its outlet nozzles 16. As shown in detail in FIG. 6, the upper surface of third layer 11 facing away from connecting channels 23 and 24 is provided with two internally threaded studs 25 for securing sole assembly 7 to housing 2.

Figure 8:
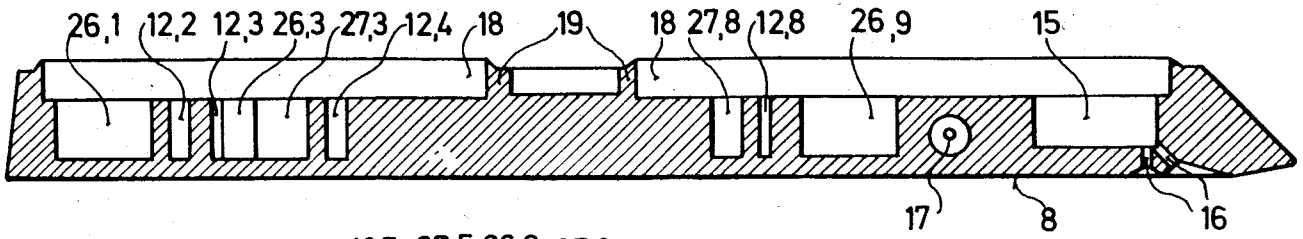
FIG. 8 shows a sectional view taken along the line VIII—VIII in FIG. 7.
Figure 7:
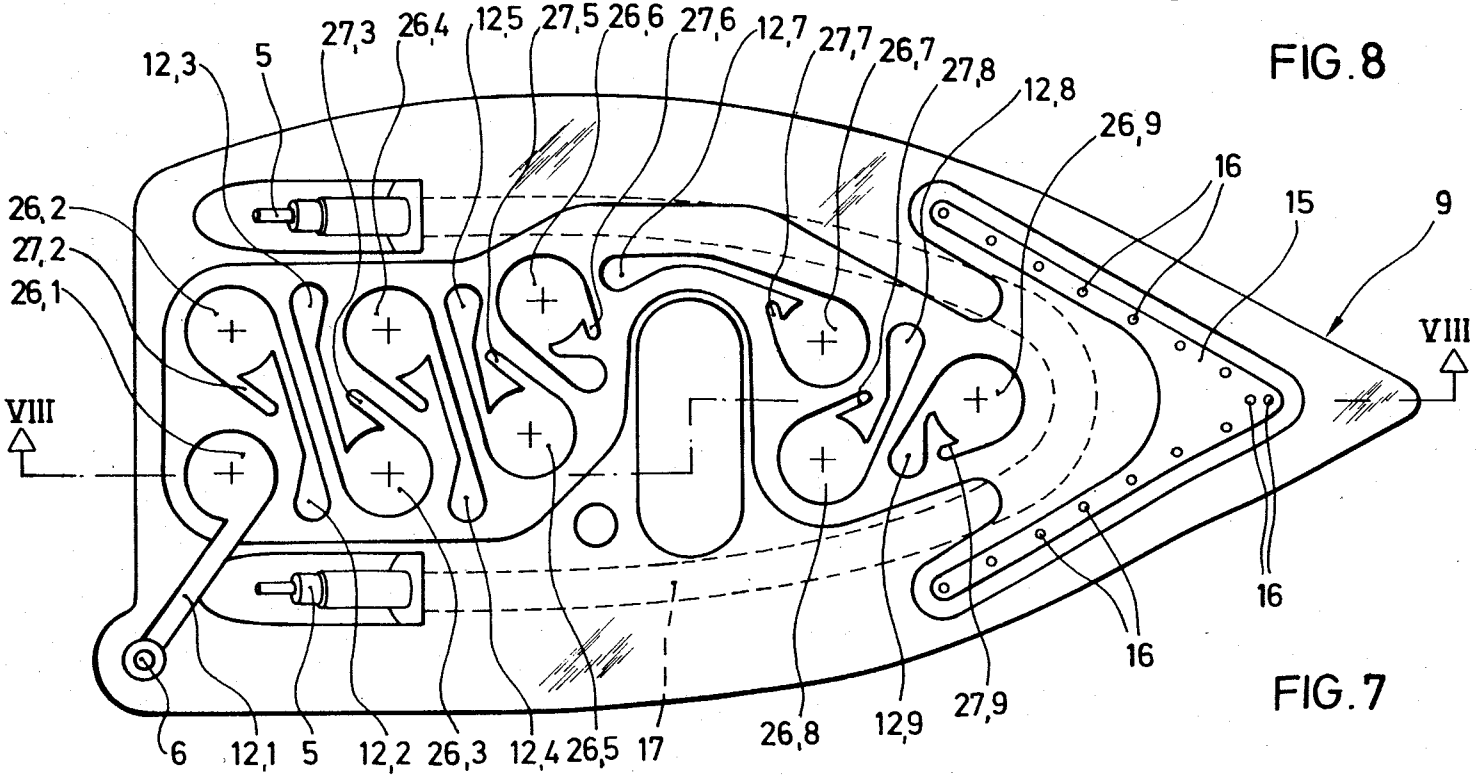
FIG. 7 shows a top plan view similar to FIG. 2 of a second embodiment of the invention.

FIGS. 7 and 8 show a second embodiment of the steam pressing iron in accordance with the invention in which the recesses are of different shape, and the elimination of water droplets is accomplished in a different manner. The remaining parts are substantially the same as in the first embodiment and are therefore designated by the same reference numerals.

In the embodiment of FIGS. 7 and 8, a plurality of recesses 26 are provided in the form of cylinders of circular cross-sectional shape having a flat bottom. One or more of the cylindrical recesses 26 is, or are, provided with a water droplet trap 27 in the form of a blind slot opening thereinto substantially diametrally opposite the respective supply channel 12 and in the opposite direction to the opening thereof. The dimensions and location of the water droplet traps may be varied in accordance with the available space. It is important, however, that in each case the supply channels 12 and water droplet traps 27 open into the recesses 26 in opposite directions, with the openings being as far apart as possible in the steam flow direction, so that the steam has to flow along an arcuate path of substantial length before it reaches the opening of the water droplet trap 27.

As shown in more detail in FIG. 8, water droplet traps 27 are likewise formed as slots extending over the full height of cylindrical recesses 26. Heater element 17 is located as closely to water droplet traps 27 as possible so as to ensure optimum evaporation of the condensate collecting in water droplet traps 27.

Second layer 10 is of course designed so as to cover the upper ends of water droplet traps 27. The diameter of outlet channels 20 has to be dimensioned in accordance with the diameter of recesses 26. Otherwise layers 10 and 11 of the first embodiment may be employed substantially without any change.

The steam conduit system according to the invention acts in the following manner: Steam supplied via supply hose 6 to supply channel 12.1 enters first recess 13,1 or 16,1, respectively.

As a result of supply channel 12,1 entering the respective recess in a tangential direction, the steam entering recess 13,1 or 26,1 is constrained to flow along a circumferentially extending flowpath, so that any entrained water droplets are caused to impinge on the cylindrical wall of the recess by the resultant centrifugal forces. The dryer steam collects in the central region and escapes upwards through outlet channel 20,1 coaxially aligned with the respective recess 13,1 or 26,1. The steam then flows through first connecting channel bore 23,1 and 21,2 into the cylindrically enlarged end portion of second supply channel 12,2, from where it enters second recess 13,2 in a tangential direction in which it is again constrained to flow along a circumferentially extending path. This results in the further elimination of water droplets by impingement thereof on the cylindrical wall of second recess 13,2 or 26,2, respectively.

In the first embodiment,the thus collected water droplets are evaporated relatively quickly on the heated wall surfaces of the respective recess 13 and the associated projection 14, the resultant steam being carried away in the main steam flow. In the second embodiment, the condensate is initially collected in the water droplet traps 27 to be evaporated therein pver a longer dwell period by contact with the heated wall surfaces.

After passing through all recesses 13 or 26 in the described manner, the steam flows through connecting channel 24 and bore 22 into distributor channel 15 from where it is distributed and directed onto the fabric through outlet nozzles 16.

For controlling the moisture content of the steam, means may be provided permitting the steam flow to be directed through a variable numer of recesses. This may be accomplished by providing further channels in addition to the described ones, such further channels permitting for instance to bypass every second recess 13 or 26. A further possibility might consist in the provision of means for connecting for instance outlet channel 20,6 of recess 13,6 or 26.6, respectively, directly to distributor channel 15 so as to bypass the last three recesses. As a further alternative it is possible for instance to connect steam supply hose 6 not to first recess 13,3 or 26,1, respectively, but to one of the downstream recesses so as to bypass one or more of the upstream recesses 13 or 26, respectively. Each of these possibilities wouls of course require the provision of valves or the like permitting the above described additional connecting paths (and eventually also the normal steam flow path) to be selectively opened and closed as required by the initial moisture content of the available steam and/or by the desired final moisture content of the steam.

The invention is not restricted to the embodiments described above and depicted in the drawings. It is thus possible to design all or only some of the recesses without the respective projections or water droplet traps. The shape, dimensions, locations and number of the recesses included in the steam conduit system together with the associated supply, outlet and connecting channels may be varied in accordance with oractical requirements and the space available.

The shape of the projections may also be different from the frustoconical configuration shown, and/or their height may be smaller than that of the respective recesses. The shape and dimensions of the base of the projections may likewise be varied.

Although the manufacture of the steam pressing iron according to the invention is greatly facilitated by the three-layer construction of the pressing iron sole, the sole may also be formed in the conventional manner as a unitary casting provided with suitable bores and threaded plugs, or in any other suitable manner.

Finally the recesses of both embodiments may be formed in a mixed arrangement in a single pressing iron sole.

I claim:

1. A steam pressing iron sole plate structure comprising a steam conduit system disposed above a pressing iron sole surface for supplying steam to steam outlet nozzles, said system including at least one recess being formed with a cylindrical wall extrending substantially perpendicular to said pressing iron sole surface, a steam supply channel opening tangentially through said cylindrical wall, and an outlet channel opening through a surface facing away from said pressing iron sole surface substantially coaxially with said cylindrical wall so that the steam entering through said supply channel is constrained to follow a helical flowpath.

2. A steam pressing iron sole plate structure comprising a steam conduit system disposed above a pressing iron sole surface for supplying steam to steam outlet nozzles, said system including at least one recess being formed with a cylindrical wall extending substantially perpendicular to said pressing iron sole surface, a steam supply channel opening tangentially through said cylindrical wall, an outlet channel opening through a surface facing away from said pressing iron sole surface substantially coaxially with said cylindrical wall so that the steam entering through said supply channel is constrained to follow a helical flowpath, and a projection disposed in said recess facing towards said pressing iron sole surface to project into said recess coaxially with said outlet channel.

3. The structure according to claim 2, characterized in that said projection is of frustoconical shape.

4. The structure according to claim 3, characterized in that said projection is coaxially disposed in said recess, the diameter of the base of said projection being smaller than the diameter of said recess at the portion thereof facing towards said pressing iron sole surface and the height of said projection substantially corresponding to the height of said recess.

5. The structure according to any one of claims 2 to 4, characterized in that at least one water droplet trap is connected to said recess.

6. A steam pressing iron sole plate structure comprising a steam conduit system disposed above a pressing iron sole surface for supplying steam to steam outlet nozzles, said system including at least one recess formed with a cylindrical wall exending substantially perpenduicular to said pressing iron sole surface, a steam supply channel opening tangentially through said cylindrical wall, an outlet channel opening through a surface facing away from said pressing iron sole surface substantially coaxially with said cylindrical wall so that the steam entering through said supply channel is constrained to follow a helical flowpath, and at least one water droplet trap being conencted to said recess.

7. The structure according to claim 6, characterized in that said water droplet trap is in the form of a blind slot opening into said recess tangentially to the cylindrical wall in a direction opposite to the opening direction of said supply channel and circumferentially spaced therefrom.

8. The structure according to any one of claims 6 or 7, characterized in that said water droplet trap extends over the full height of the cylindrical wall of said recess.

9. A steam pressing iron sole plate structure comprising a steam conduit system disposed above a pressing iron sole surface for supplying steam to steam outlet nozzles, said system including as plurality of recesses arranged in series in the direction of steam supply, each being formed with a cylindrical wall extending substantially perpendicular to said pressing iron sole surface and each having a steam supply channel opening tangentially through said cylindrical wall, an outlet channel opening through a surface facing away from said pressing iron sole surface substantially coaxially with the cylindrical wall so that the steam entering through said supply channel is constrained to follow a helical flowpath, said outlet channel of any upstream recess communicating with said supply channel of the respective adjacent downstream recess.

10. The structure according to claim 9, characterized in that means are provided permitting the steam to be directed towards said steam outlet nozzles bypassing at least one of said recesses.

11. The structure according to claim 9, characterized in that said pressing iron sole plate consists of three component layers, the first component layer having said sole surface and being formed with said recesses and with said supply channels, the second component layer being formed with said outlet channels, and the third component layer being formed with connecting channels between said outlet channel and said supply channels.

12. The structure according to claim 11, characterized in that in said first component layer a projection is disposed in each recess facing towards said pressing iron sole surface to project into said recess coaxially with said outlet channel.

13. The structure according to claim 11, characterized in that in said first component layer at least one water droplet trap is connected to each recess.

14. A structure according to claims 1 or 2 or 6 or 9, characterized by heater means disposed in the vicinity of said recess.

* * * * *

UNITED STATES PATENT AND TRADEMARK OFFICE

CERTIFICATE OF CORRECTION

PATENT NO. : 4,594,800

DATED : June 17, 1986

INVENTOR(S) : Eggert Herrmann

It is certified that error appears in the above-identified patent and that said Letters Patent is hereby corrected as shown below:

Claim 1, line 5, change "extrending" to --extending--.

Claim 6, line 5, change "exending" to --extending--.

Claim 6, lines 5 and 6, change "perpenduicular" to --perpendicular--.

Claim 6, line 13, change "conencted" to --connected--.

Signed and Sealed this

Twenty-seventh Day of January, 1987

*Attest:*

DONALD J. QUIGG

*Attesting Officer* *Commissioner of Patents and Trademarks*